US011771612B2

(12) United States Patent
Yoshimi et al.

(10) Patent No.: US 11,771,612 B2
(45) Date of Patent: Oct. 3, 2023

(54) ASSIST DEVICE

(71) Applicant: JTEKT CORPORATION, Osaka (JP)

(72) Inventors: Yoshitaka Yoshimi, Kashiba (JP); Kazuyoshi Ohtsubo, Chiryu (JP); Tomoki Arai, Kitakatsuragi-gun (JP); Hiromichi Ohta, Kariya (JP)

(73) Assignee: JTEKT CORPORATION, Kariya (JP)

( * ) Notice: Subject to any disclaimer, the term of this patent is extended or adjusted under 35 U.S.C. 154(b) by 372 days.

(21) Appl. No.: 17/019,815

(22) Filed: Sep. 14, 2020

(65) Prior Publication Data

US 2021/0077335 A1 Mar. 18, 2021

(30) Foreign Application Priority Data

Sep. 17, 2019 (JP) ..... 2019-168402
Sep. 17, 2019 (JP) ..... 2019-168621

(51) Int. Cl.
*A61H 1/02* (2006.01)

(52) U.S. Cl.
CPC ..... *A61H 1/0229* (2013.01); *A61H 2201/018* (2013.01); *A61H 2201/164* (2013.01);
(Continued)

(58) Field of Classification Search
CPC ..... A61H 1/0229; A61H 3/00; A61H 1/024; A61H 2205/081; A61F 5/0102;
(Continued)

(56) References Cited

U.S. PATENT DOCUMENTS

2014/0163435 A1* 6/2014 Yamamoto ..... A61H 3/00 601/35
2015/0173993 A1* 6/2015 Walsh ..... A63B 23/0355 414/4

(Continued)

FOREIGN PATENT DOCUMENTS

JP 2011-251001 A 12/2011
JP 2018-199205 A 12/2018
WO 2019/172209 A1 9/2019

OTHER PUBLICATIONS

Japanese Office Action issued in Japanese Patent Application No. 2019-168402 dated Jun. 20, 2023 (w/ partial English translation).

(Continued)

*Primary Examiner* — Samchuan C Yao
*Assistant Examiner* — Nathan M Le
(74) *Attorney, Agent, or Firm* — Oblon, McClelland, Maier & Neustadt, L.L.P.

(57) ABSTRACT

An assist device includes: a first harness to be fitted to at least one of a shoulder region and a breast region of a user; a second harness configured to be fitted to one of a leg region and a waist region, of the user; a belt body provided so as to extend to the first harness and to the second harness along a back side of the user; an actuator provided in one of the first harness and the second harness; and a controller performs operation control of the actuator. The actuator winds a part of the belt body and unwinds the part of the belt body. The controller performs the operation control of the actuator based on a posture change of the user.

9 Claims, 13 Drawing Sheets

(52) U.S. Cl.
CPC ..... *A61H 2201/1619* (2013.01); *A61H 2201/1652* (2013.01); *A61H 2201/5058* (2013.01); *A61H 2230/62* (2013.01)

(58) Field of Classification Search
CPC ..... A63B 21/40005; A63B 21/4007; A63B 21/4009; B25J 9/0006
See application file for complete search history.

(56) References Cited

U.S. PATENT DOCUMENTS

| | | | | |
|---|---|---|---|---|
| 2016/0107309 | A1* | 4/2016 | Walsh | A63B 21/0054 248/550 |
| 2016/0184166 | A1* | 6/2016 | Takenaka | A61H 3/00 623/57 |
| 2017/0027735 | A1* | 2/2017 | Walsh | A61F 5/0123 |
| 2017/0181917 | A1* | 6/2017 | Ohta | B25J 9/0006 |
| 2018/0064218 | A1* | 3/2018 | Jang | A45B 9/00 |
| 2018/0092794 | A1* | 4/2018 | Murakami | A61H 1/0262 |
| 2018/0116851 | A1* | 5/2018 | Lee | A61F 5/0102 |
| 2018/0133091 | A1* | 5/2018 | Sato | A61H 3/00 |
| 2018/0272525 | A1 | 9/2018 | Kumeno et al. | |
| 2018/0325764 | A1* | 11/2018 | Yagi | B25J 11/009 |
| 2019/0282424 | A1* | 9/2019 | Lerner | A61H 3/00 |
| 2020/0281799 | A1* | 9/2020 | Geffard | A61H 3/00 |

OTHER PUBLICATIONS

Japanese Office Action issued in Japanese Patent Application No. 2019-168621 dated Jun. 20, 2023 (w/ partial English translation).

* cited by examiner (FORWARD-TILTED POSTURE)

(UPRIGHT POSTURE)

FIG. 9 i2

| POSTURE ANGLE θL | ASSIST FORCE τa, ref | OUTPUT TORQUE OF MOTOR |
|---|---|---|
| 1 | A | a |
| 2 | B | b |
| ⋮ | ⋮ | ⋮ |
| 30 | C | c |
| ⋮ | ⋮ | ⋮ |
| 90 | D | d |
| ⋮ | ⋮ | ⋮ |

ASSIST DEVICE

CROSS-REFERENCE TO RELATED APPLICATION

This application claims priority to Japanese Patent Application No. 2019-168402 filed on Sep. 17, 2019 and Japanese Patent Application No. 2019-168621 filed on Sep. 17, 2019, each incorporated herein by reference in its entirety.

BACKGROUND

1. Technical Field

The disclosure of the present disclosure relates to an assist device.

2. Description of Related Art

Various assist devices that assist a user's work by being worn on the body of the user (human being) have been proposed. For example, even where a user lifts a heavy object, an assist device enables the user to perform the work with a small strength (burden). Such assist device is disclosed in, for example, Japanese Patent Application Publication No. 2018-199205 (JP 2018-199205 A).

SUMMARY

The assist device disclosed in JP 2018-199205 A includes a frame made of, e.g., a metal, the frame being fitted to a user. An output of an actuator mounted in the frame is transmitted to the upper body and the lower body of the user through a link mechanism. Consequently, for example, a motion of lifting a heavy object is assisted.

Examples of motions for which a user needs assistance include motions of assisting (helping) a person such as a patient or an elderly person in activities of daily living in addition to motions involving a large burden such as lifting a heavy object. When a user performs work involving a heavy burden, a high-power assist device such as one disclosed in JP 2018-199205 A is effective.

However, when a user assists a person such as a patient or an elderly person, a high-power assist device may be excessive in performance. Also, a high-power assist device uses many rigid members such as a link mechanism and a frame made of, e.g., metal, and has a solid configuration in order to achieve a high output. Therefore, the assist device is heavy in weight and movement of the user is restricted by the rigid members.

Therefore, the inventor of the present disclosure has already proposed assist devices that are light in weight and provide good wear comfort (for example, Japanese Patent Application No. 2019-043462). Each of such assist devices includes a first harness to be fitted to a shoulder region of a user, second harnesses to be fitted to left and right leg regions of the user, a belt body provided so as to extend to the first harness and to the second harnesses along the back side of the user, and an actuator. The actuator is provided in the first harness and enables winding and unwinding a part of the belt body.

Upon the actuator winding a part of the belt body, tension acts on the belt body. The tension serves as an assist force and acts on the user. Consequently, for example, when the user assists a person as stated above, a burden is reduced.

In an assist device including a belt body such as above, it is preferable that an assist force acting on a user have a strength according to, e.g., a posture of the user, rather than being always constant. Therefore, an object of the present disclosure is to provide an assist device that is light in weight, provides good wear comfort and can generate an assist force of a proper strength according to, e.g., a posture of a user.

An aspect of the present disclosure provides an assist device. The assist device includes: a first harness to be fitted to at least one of a shoulder region and a breast region of a user; a second harness configured to be fitted to one of a leg region and a waist region, of the user; a belt body provided so as to extend to the first harness and to the second harness along a back side of the user; an actuator provided in one of the first harness and the second harness; and a controller configured to perform operation control of the actuator. The actuator is configured to wind a part of the belt body and is configured to unwind the part of the belt body. The controller is configured to perform the operation control of the actuator based on a posture change of the user.

With the assist device having the above configuration, upon the actuator winding the belt body, tension acts on the belt body. The tension causes generation of an assist force for assisting the user's work, which reduces a burden on the body of the user. The belt body is light in weight and can conform to the body of the user even if the user changes his/her posture, and thus, follows movement of the user. Therefore, an assist device that provides good wear comfort can be provided.

In the above assist device, the controller may be configured to obtain a posture parameter indicating a posture of the user based on an amount of operation of the actuator in winding or unwinding of the belt body due to the posture change of the user and may be configured to perform the operation control of the actuator based on the posture parameter in order to provide an assist force to the user.

With the above configuration, upon the actuator winding the belt body, tension acts on the belt body. The tension causes generation of an assist force for assisting the user's work, which reduces a burden on the body of the user. The belt body is light in weight and can conform to the body of the user even if the user changes his/her posture, and thus, follows movement of the user. Therefore, an assist device that provides good wear comfort can be provided.

It is desirable that an assist device generate an assist force according to a posture of a user. Therefore, with the above configuration, upon a user changing his/her posture, the belt body is wound or unwound according to the change and the actuator operates in the winding or unwinding. There is a correlation between a change of a posture of a user and an amount of operation of the actuator. Therefore, a posture parameter is obtained based on the amount of operation. In order to provide an assist force to the user, the operation control of the actuator is performed based on the posture parameter. As a result, it is possible to generate an assist force according to the user's posture.

In the above assist device, one of the first harness and the second harness may further include a sensor that outputs a signal according to a posture of the user. The controller may be configured to perform the operation control of the actuator in order to provide an assist force to the user, using an output of the sensor.

With the above configuration, upon the actuator winding the belt body, tension acts on the belt body. The tension causes generation of an assist force for assisting the user's work, which reduces a burden on the body of the user. The belt body is light in weight and can conform to the body of the user even if the user changes his/her posture, and thus, follows movement of the user. Therefore, an assist device that provides good wear comfort can be provided.

It is desirable that an assist device generate an assist force according to a posture of a user. Therefore, with the above configuration, a signal according to a posture of a user is output from the sensor. The operation control of the actuator is performed in order to provide an assist force to the user, using the output of the sensor, enabling generating an assist force according to the posture of the user.

In the above assist device, the controller may include a storage section, a posture estimation section and a determination section. The storage section may be configured to store correspondence information indicating a relationship between the amount of operation of the actuator in winding or unwinding of the belt body due to the posture change of the user, and the posture parameter. The posture estimation section may be configured to, upon the amount of operation of the actuator being obtained along with the posture change of the user, obtain the posture parameter based on the amount of operation and the correspondence information. The determination section may be configured to obtain a physical amount for making the actuator operate, based on the obtained posture parameter.

With the above configuration, upon a user changing his/her posture to a predetermined posture and an amount of operation of the actuator at the time of the posture change being obtained, a posture parameter can be obtained based on the correspondence information stored in advance. The posture parameter indicates the posture of the user. A physical amount for making the actuator operate according to the posture parameter (the posture of the user) is determined based on the obtained posture parameter. Consequently, the assist device can generate an assist force of a proper strength according to the posture of the user.

In the above assist device, the controller may include a posture estimation section and a determination section. The posture estimation section may be configured to estimate a posture parameter indicating the posture of the user. The determination section may be configured to obtain a physical amount for making the actuator operate, based on the estimated posture parameter. The posture estimation section may be configured to estimate the posture parameter based on the output of the sensor, using a result of one of first estimation processing and second estimation processing. The first estimation processing may be estimation processing performed based on an amount of operation of the actuator in winding or unwinding of the belt body due to the posture change of the user and the second estimation processing may be estimation processing performed based on the output of the sensor.

In this case, a physical amount for making the actuator operate based on a posture parameter indicating a posture of a user is obtained. Consequently, an assist force according to the posture of the user can be generated by the actuator. Depending on the state or motion of the user, estimating a posture parameter based on an output of the sensor may cause an error. Therefore, with the above configuration, where it is proper to estimate a posture parameter using the sensor, the second estimation processing is performed, and where it is not proper to estimate a posture parameter using the sensor, the first estimation processing, which is based on an amount of operation of the actuator, is performed.

As above, in order to estimate a posture parameter, a result of one of the first estimation processing and the second estimation processing is used. Therefore, there may be a large difference in estimated posture parameter between last and this time. As a result, the physical amount for making the actuator operate may largely change and such large change may make the user feel odd. In the above assist device, the posture estimation section may be configured to repeatedly perform estimation of the posture parameter. The posture estimation section may be configured to, where an amount of change of the posture parameter exceeds a threshold value, obtain a new posture parameter based on the past estimated posture parameter and the amount of change.

With the above configuration, even if there is a large difference in posture parameter estimated by the posture estimation section between last time and this time, a new posture parameter is obtained based on the posture parameter estimated in the past and an amount of the change. Therefore, it becomes possible to prevent the physical amount for making the actuator operate from largely changing.

Where the body height of the user is different, the amount of operation of the actuator may be different even though the change of the posture is the same. Therefore, in the above assist device, the correspondence information may be information set for respective body heights for the user. With the above configuration, even though the body height of the user is different, the posture parameter can be obtained.

In the above assist device, the storage section may be configured to store conversion information indicating a relationship between the posture parameter and the assist force to be provided to the user. The determination section may be configured to, upon the posture parameter being obtained, determine the assist force based on the conversion information and may be configured to obtain the physical amount corresponding to the assist force. The above configuration enables the assist device to generate an assist force of a proper strength according to a posture of a user via relatively simple processing.

Also, the belt body has a certain thickness. If the actuator includes a pulley capable of winding the belt body and a motor for making the pulley perform an operation of winding the belt body, even where the motor makes the belt body be wound on the pulley with a same output, a torque in the pulley for generating an assist force may change because of an effect of the thickness of the belt body.

Therefore, in the above assist device, the actuator may include a pulley configured to wind the belt body and a motor configured to make the pulley perform an operation of winding the belt body. The determination section may be configured to correct the determined assist force using a radius of the pulley including the belt body wound on the pulley. With the above configuration, where a physical amount for making the actuator operate is obtained in order to obtain an assist force to be provided to a user, the effect of the thickness of the belt body wound on the pulley is eliminated by performing the above correction.

In the above assist device, the controller may be configured to perform the operation control of the actuator in order to provide an assist force to the user, using an amount of operation of the actuator in winding or unwinding of the belt body due to the posture change of the user, and an output of the sensor. The above configuration enhances an accuracy of estimating a posture of a user, and thus, the assist device can generate an assist force of a proper strength according to the posture of the user.

The assist device of the present disclosure is light in weight, provides good wear comfort and enables generating an assist force of a proper strength according to, e.g., a posture of a user.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein:

FIG. 9 is a diagram of conversion information;

DETAILED DESCRIPTION OF EMBODIMENTS

Overall Configuration of Assist Device 10

Figure 1:
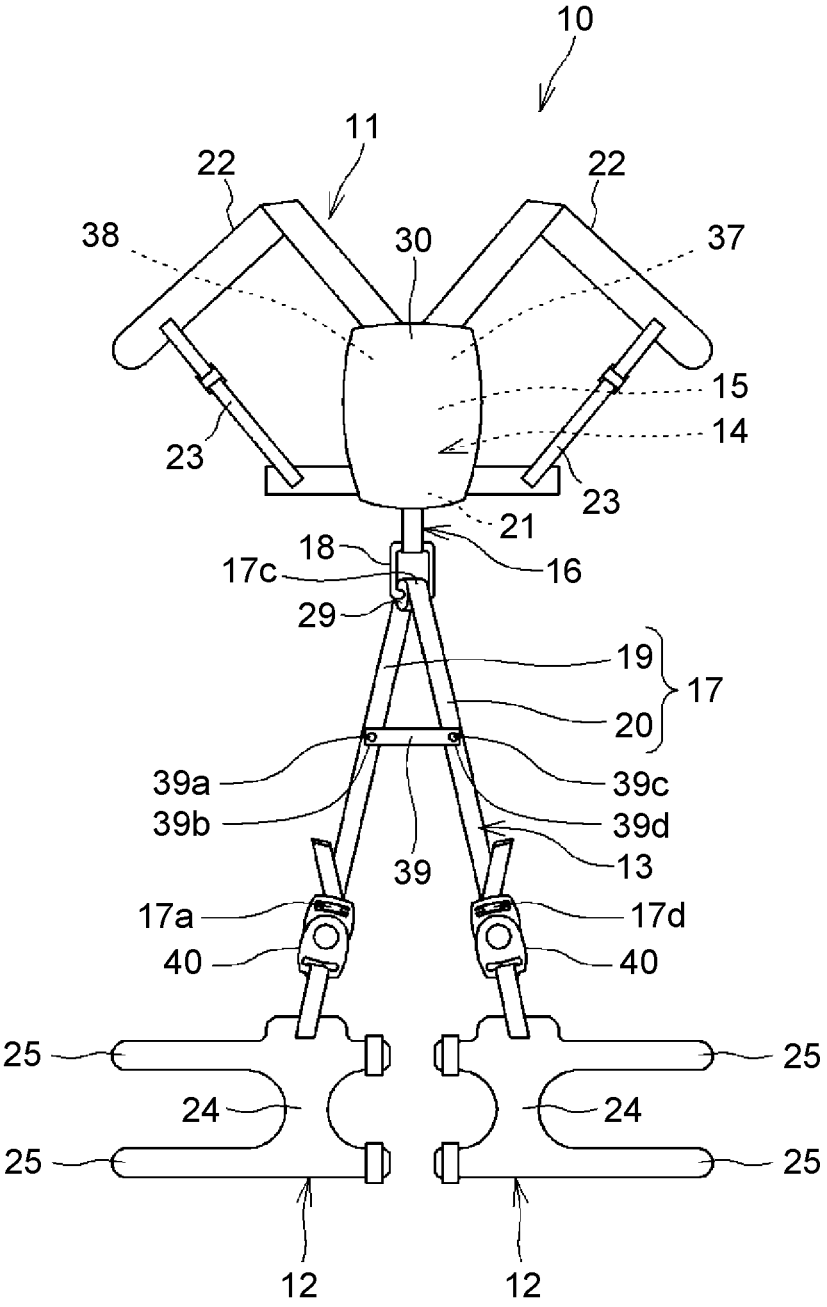
FIG. 1 is a back view illustrating an example of an assist device.
Figure 2:
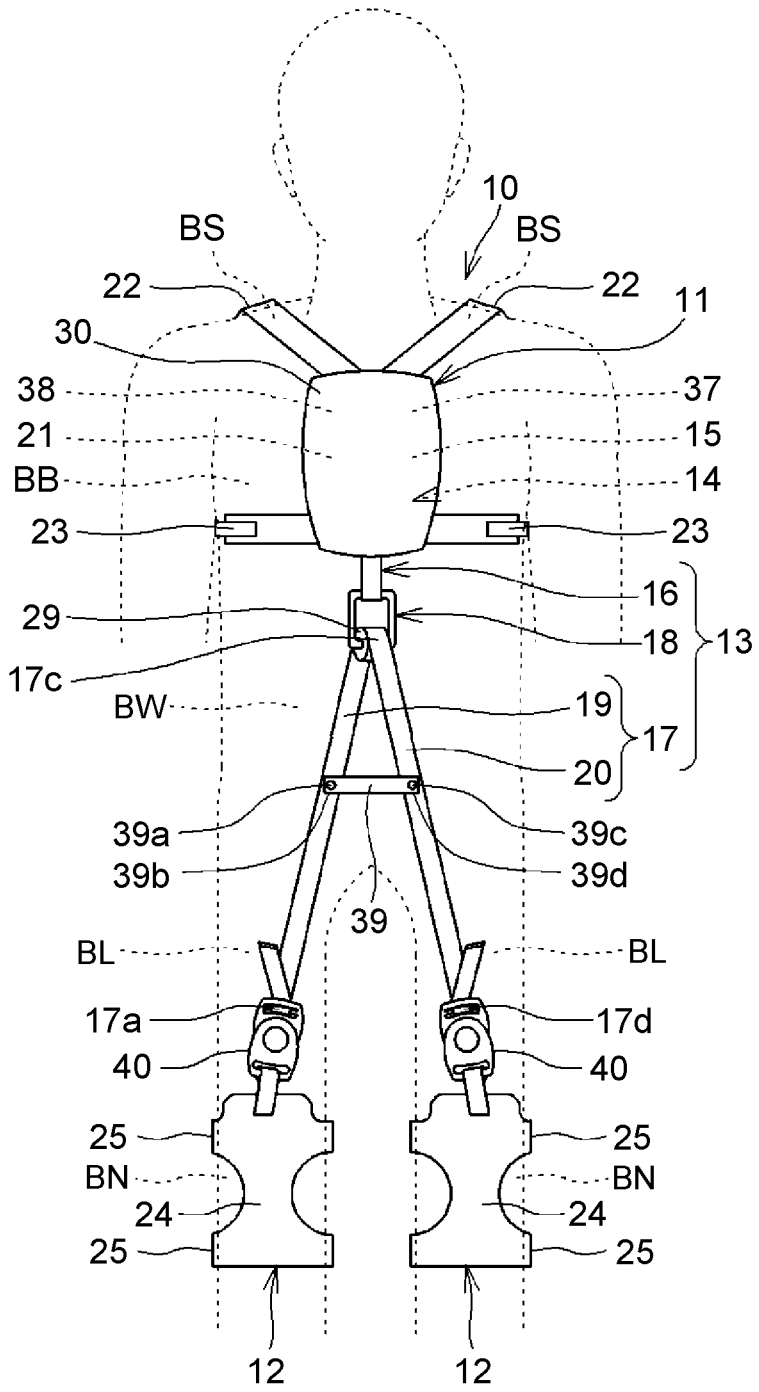
FIG. 2 is a back view of the assist device attached to the body of a user.
Figure 3:
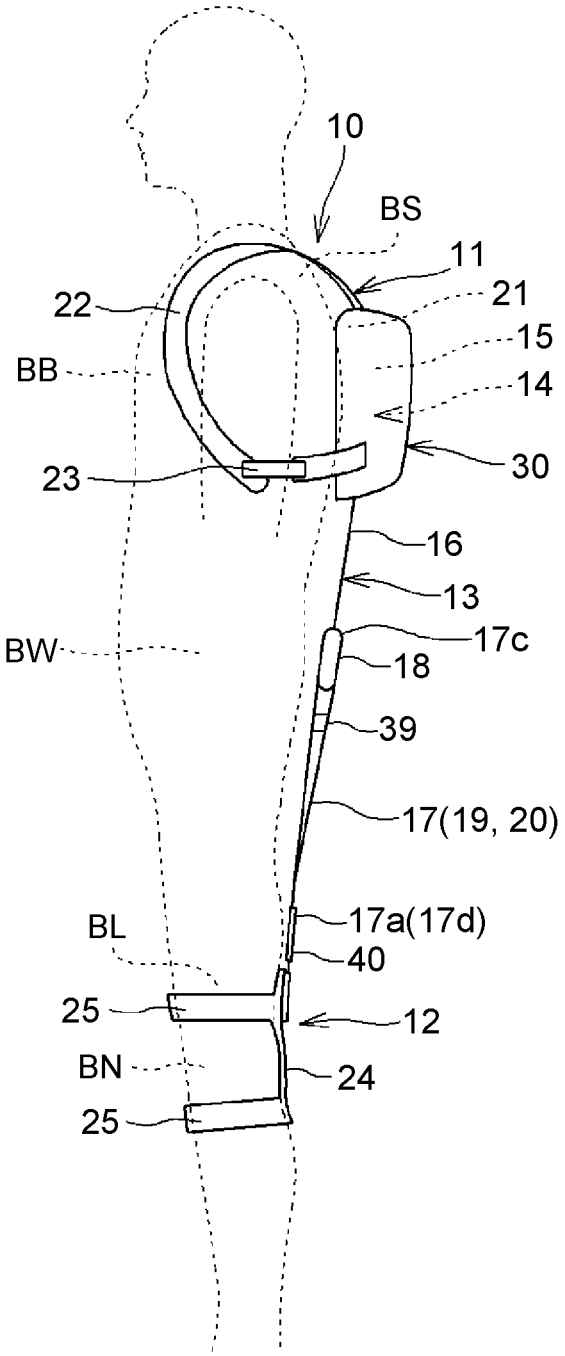
FIG. 3 is a side view of the assist device attached to the body of the user.
Figure 4:
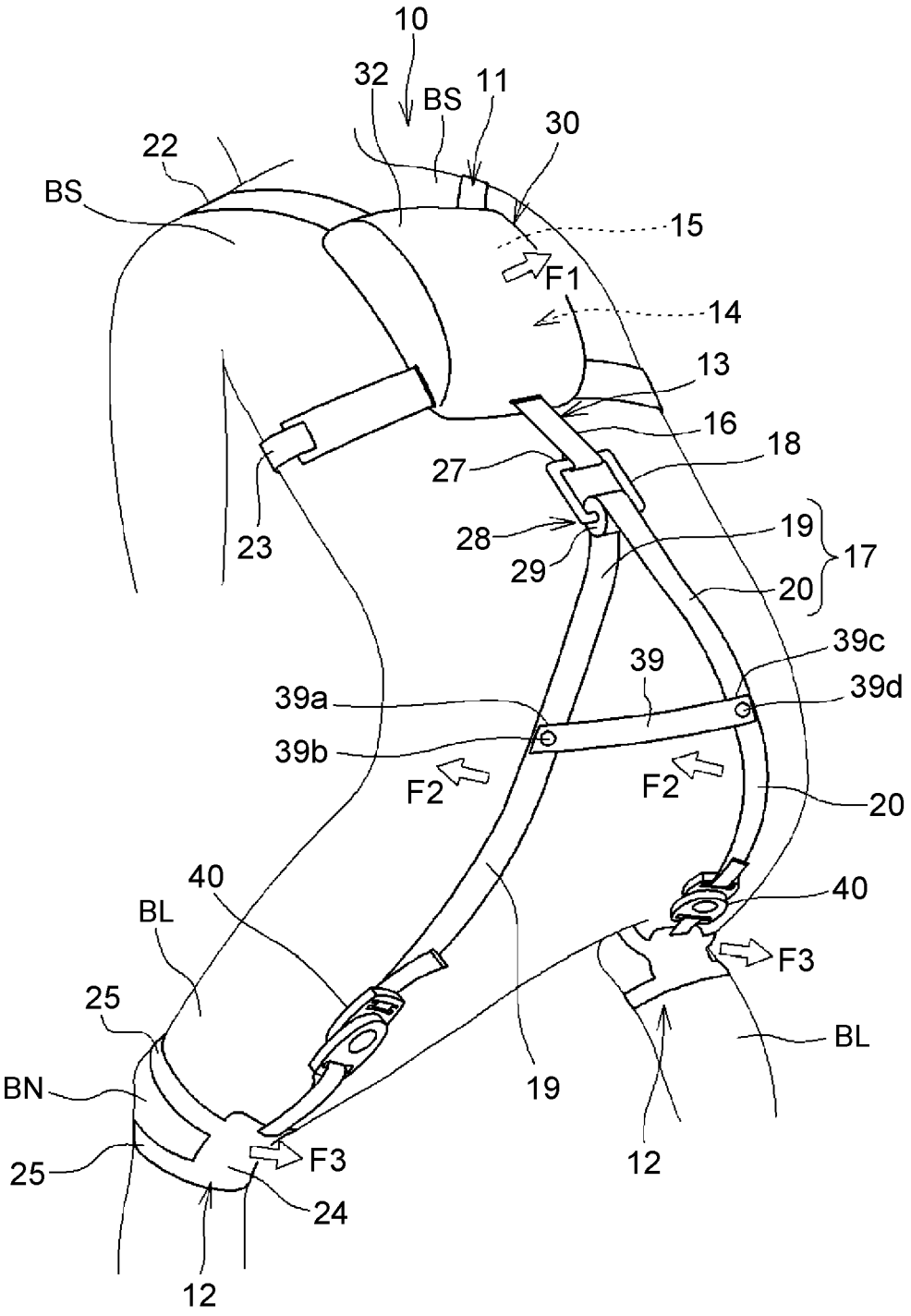
FIG. 4 is a diagram illustrating the user wearing the assist device in a forward-tilted posture.

FIG. 1 is a back view illustrating an example of an assist device. FIG. 2 is a back view of the assist device attached to the body of a user. FIG. 3 is a side view of the assist device attached to the body of the user. FIG. 4 is a diagram illustrating the user wearing the assist device having a forward-tilted posture (stooped posture). The assist device 10 illustrated in FIG. 1 includes one first harness 11 to be fitted to left and right shoulder regions BS, which are parts of the body of a user (human being), and two second harnesses 12 to be fitted to left and right leg regions BL, which are other parts of the body of the user. The first harness 11 only needs to be fitted to at least either the shoulder regions BS or a breast region BB of the user, and also, may have a form other than the illustrated form. In the present disclosure, the second harnesses 12 are fitted to respective knee regions BN in the leg regions BL. The second harnesses 12 also may have a form other than the illustrated form.

In the assist device 10 of the present disclosure, "left" and "right" are the user's own left and right when the user has an upright posture wearing the assist device 10 and "front" and "rear" are the user's own front and rear, "upper (up)" and "lower (down)" are the user's own upper and lower sides. "Upper (up)" is the head side of the user and "lower (down)" is the foot side of the user.

The assist device 10 includes a belt body 13, an actuator 14, a controller 15, a battery 37 and a sensor 38 in addition to the first harness 11 and the left and right second harnesses 12.

The first harness 11 is fitted to the shoulder region BS of the user. One second harness 12 is fitted to the left knee region BN of the user. The other second harness 12 is fitted to the right knee region BN of the user. The left second harness 12 and the right second harness 12 are bilaterally symmetrical and have a same configuration. The first harness 11 and the two second harnesses 12 are fitted to respective regions away from each other across a waist region BW, which are joints of the user, that is, the shoulder regions BS and the leg regions BL.

The first harness 11 is formed of, e.g., flexible fabric. The first harness 11 includes a back body portion 21 to be fitted to the back of the user, and shoulder belts 22 and underarm belts 23 connecting with the back body portion 21. The shoulder belts 22 and the underarm belts 23 allow the back body portion 21 to be held on the back of the user. The underarm belts 23 connect the back body portion 21 and the respective shoulder belts 22 and are adjustable in length. By adjustment of the length of each underarm belt 23, the back body portion 21 is brought into close contact with the user. The first harness 11 is fitted to the shoulder regions BS so as to be incapable of moving forward and backward, leftward and rightward, and upward and downward. The first harness 11 may include a stiff member, for example, as a part to be hung on the shoulder regions BS.

The second harnesses 12 are each formed of, e.g., flexible fabric. Each second harness 12 includes a knee body portion 24 to be fitted to the rear side of the relevant knee region BN of the user, and knee belts 25 provided so as to extend from the knee body portion 24. The knee belts 25 extend around the knee region BN at respective positions above and below the knee region BN, and the distal end side of each knee belt 25 is fixed to the knee body portion 24. The knee belt 25 can be adjusted in length of wrapping of the knee region BN, by a locking member such as a belt and a buckle or a hook-and-loop fastener. By the adjustment, the knee body portion 24 is brought into a close contact with the rear side of the knee region BN. The second harnesses 12 are fitted to the knee regions BN so as to be incapable of moving forward and backward, leftward and rightward, and upward and downward.

The belt body 13 is provided along the back side of the user so as to connect the first harness 11 and the second harness 12. The belt body 13 includes a first belt 16 provided on the upper body side, a second belt 17 provided on the lower body side, and a joining member 18 joining the first belt 16 and the second belt 17. Each of the first belt 16 and the second belt 17 is long and flexible. The joining member 18 is made of a metal and is formed by a rectangular ring-like body called "rectangular ring".

Each of the first belt 16 and the second belt 17 is a band-like member made of fabric or leather and is bendable along a shape of the body. Note that each of the first belt 16 and the second belt 17 may be a string-like belt (wire-like member). Each of the first belt 16 and the second belt 17 of the present disclosure is a non-stretchable member, that is, has a characteristic of being hard to stretch in a longitudinal direction of the first belt 16 or the second belt 17 or a characteristic of not stretching in the longitudinal direction.

Figure 5:
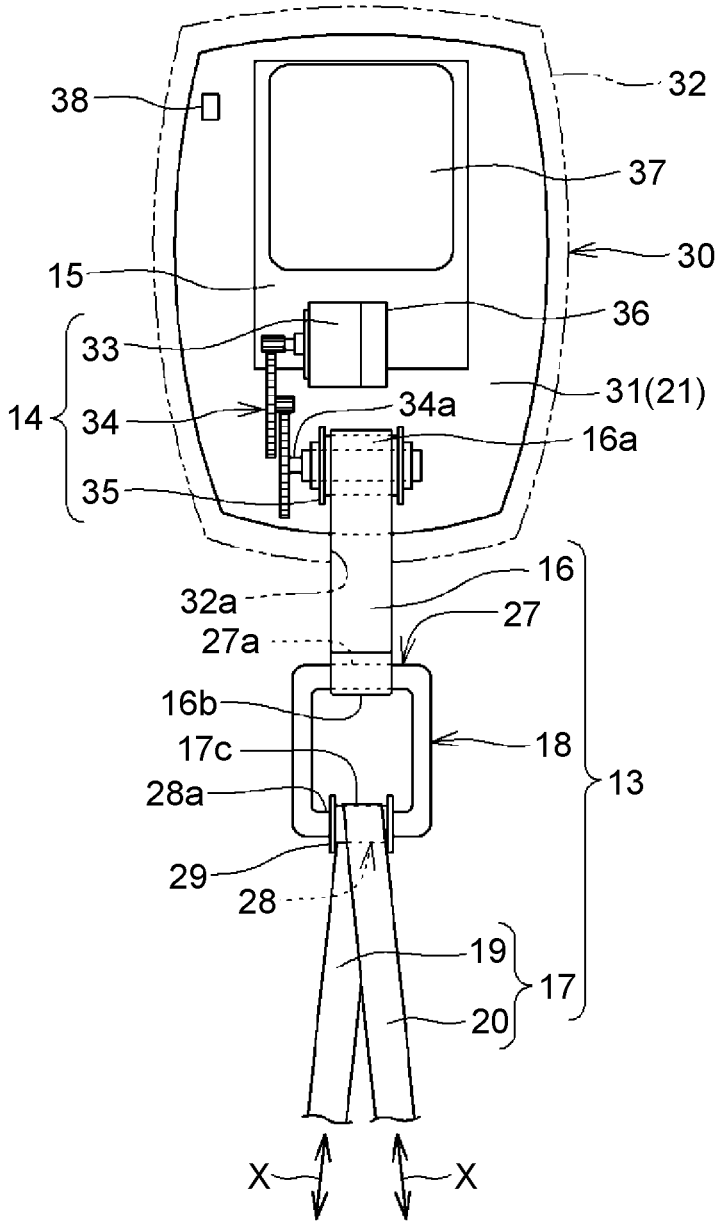
FIG. 5 is a diagram of a control box and a belt body.

The assist device 10 of the present disclosure includes a control box 30. The control box 30 is provided in the back body portion 21 of the first harness 11. FIG. 5 is a diagram of the control box 30 and the belt body 13. The control box 30 includes a base 31 having a plate-like shape and a cover 32 that covers the base 31. In order to describe an inner structure of the control box 30, in FIG. 5, the cover 32 is indicated by an imaginary line (alternate long and two short dashes line). The base 31 may be the back body portion 21 of the first harness 11.

The actuator 14, the controller 15, the battery 37, the sensor 38, etc., are provided in space between the base 31 and the cover 32. In the cover 32, an opening (cutout) 32*a* is formed and the first belt 16 extends through the opening 32*a*.

The actuator 14 is provided inside the control box 30. In other words, the actuator 14 is provided in the first harness 11. The actuator 14 enables winding and unwinding of a part of the belt body 13. For that purpose, the actuator 14 includes a motor 33, a reducer section 34 and a drive pulley 35. The motor 33 is a brushless DC motor. The motor 33 can rotate with a predetermined torque at a predetermined rotation frequency based on a drive signal output from the controller 15. The motor 33 can rotate in forward and reverse directions based on a drive signal output from the controller 15.

A parameter relating to rotation, such as a rotational angle, a rotation speed or a rotation frequency, of the motor 33 is detected by a rotation detector 36 attached to the motor 33. The rotation detector 36 of the present disclosure is a rotary encoder but may be a Hall sensor or a resolver. A result of detection by the rotation detector 36 is input to the controller 15. By the controller 15 controlling operation of the motor 33 based on the result of detection, the assist device 10 can generate a proper assist force.

The reducer section 34 is formed by a plurality of gears, reduces the rotation frequency of the motor 33 and rotates an output shaft 34*a* of the reducer section 34. The drive pulley 35 is joined to the output shaft 34*a* and thus rotates together with the output shaft 34*a*. One end portion 16*a* side of the first belt 16 is attached to the drive pulley 35. Upon the drive pulley 35 rotating in one direction by forward rotation of the motor 33, the first belt 16 is wound on the drive pulley 35. Upon the drive pulley 35 rotating in the other direction by reverse rotation of the motor 33, the first belt 16 is unwound from the drive pulley 35.

As above, the actuator 14 includes the drive pulley 35 that can wind the belt body 13, and the motor 33 for making the drive pulley 35 perform an operation of winding the belt body 13. The first belt 16 is wound and unwound by the actuator 14.

The controller 15 is formed by a control unit including a microcomputer. As also described later, the controller 15 controls operation of the actuator 14 (motor 33). As the sensor 38, an acceleration sensor is provided. A signal from the sensor 38 is input to the controller 15. The controller 15 can estimate a posture of the user based on the signal from the sensor 38. The battery 37 supplies electric power to the controller 15, the motor 33, the rotation detector 36 and the sensor 38. The sensor 38 may be provided outside the control box 30.

Belt Body 13

As described above, the belt body 13 includes a first belt 16, a second belt 17 and a joining member 18. One end portion 16*a* side of the first belt 16 is wound on the drive pulley 35 and is fixed. The other end portion 16*b* side of the first belt 16 is fixed to the joining member 18. Upon the first belt 16 being wound on the drive pulley 35, the joining member 18 is pulled up. Upon the joining member 18 being forcibly pulled down, the first belt 16 is unwound (pulled out) from the drive pulley 35. An amount of winding or unwinding (pullout) of the first belt 16 in the drive pulley 35 and an amount of rotation of an output shaft of the motor 33 are correlated with each other. A parameter relating to rotation of the motor 33 accompanying winding or unwinding of the belt body 13 is detected by the rotation detector 36.

As described above, the joining member 18 is formed by a rectangular ring-like body. A shaft portion 27*a* on one side (upper side) of the ring-like body is a first attachment portion 27, and the end portion 16*b* of the first belt 16 is attached to the first attachment portion 27. In the present disclosure, the first belt 16 is undetachable from the first attachment portion 27, but may be detachable by use of, e.g., a buckle.

The other side (lower side) of the rectangular ring-like body forming the joining member 18 is a second attachment portion 28 for attaching the second belt 17. As described above, the joining member 18 includes the first attachment portion 27 for attaching the first belt 16 and the second attachment portion 28 for attaching the second belt 17.

The second attachment portion 28 supports the second belt 17 in such a manner that the second belt 17 is folded at an intermediate point (intermediate portion 17*c*) of the second belt 17. The second attachment portion 28 of the present disclosure includes a shaft portion 28*a* integrated with the first attachment portion 27, and a rotary pulley 29 rotatably supported on the shaft portion 28*a*. The second belt 17 is hung on the rotary pulley 29 so as to be folded at an intermediate point of the second belt 17. This configuration provides a configuration in which the second belt 17 is not fixed to the second attachment portion 28 but the second belt 17 is supported so as to be movable in opposite directions in the longitudinal direction (arrow X directions in FIG. 5) in a state in which the second belt 17 is folded.

In FIG. 2, the second belt 17 is attached to the second harnesses 12. More specifically, the second belt 17 is formed of a single band-like member. One end portion 17*a* side of the second belt 17 is attached to the left second harness 12. The other end portion 17*d* side of the second belt 17 is attached to the right second harness 12. As above, the intermediate portion 17*c* of the second belt 17 is put on the joining member 18.

According to the above configuration of the second belt 17, the second belt 17 includes a left second belt portion 19 extending from the joining member 18 to the left second harness 12 and a right second belt portion 20 extending from the joining member 18 to the right second harness 12. As above (see FIG. 5), the second belt 17 is hung on the second attachment portion 28 (rotary pulley 29) and not fixed, a length of the left second belt portion 19 and a length of the right second belt portion 20 can freely be changed. However, a total of the length of the left second belt portion 19 and the length of the right second belt portion 20 is fixed. This configuration prevents, for example, walking of the user from being restricted by the second belt 17, and thus, enables the user to easily walk.

The second belt 17 further includes a connecting member 39 connecting the left second belt portion 19 and the right second belt portion 20. The connecting member 39 connects the left second belt portion 19 and the right second belt portion 20 at intermediate positions between the folded portion (intermediate portion 17*c*) of the second belt 17 and respective fixation parts of the two second harnesses 12 (one end portion 17*a* and the other end portion 17*d*). The folded portion is a part of the second belt 17, the part being folded at the joining member 18. The fixation portions are parts of the second belt 17, the parts being fixed to the two second harnesses 12, respectively.

For example, where the user changes his/her posture from an upright posture to a stooped posture as illustrated in FIG. 4, the connecting member 39 enables preventing an increase in lateral distance between the left second belt portion 19 and the right second belt portion 20. In other words, the connecting member 39 enables preventing a failure of the left second belt portion 19 and the right second belt portion 20 to extend along the respective back sides of the leg regions BL of the user.

Sensor 38 and Controller 15

In FIG. 5, as described above, the sensor 38 is formed by an acceleration sensor. The controller 15 can perform various types of arithmetic processing. By the controller 15 performing arithmetic processing of a signal from the sensor 38, a motion and a posture of the user can be detected. The sensor 38 has a configuration that outputs a signal according to a posture of the user, and thus functions as a posture detector for detecting a posture of the user. For example, it is possible to detect whether a posture of the upper body of the user is a forward-tilted posture or an upright posture or detect that the user has taken a crouching posture.

Also, an amount of winding and unwinding of the belt body 13 in the drive pulley 35 by the motor 33 and a posture of the user are correlated with each other. Therefore, the controller 15 can estimate a posture of the user based on a rotational angle of the motor 33 detected by the rotation detector 36.

The controller 15 processes a signal from one or each of both of the sensor 38 and the rotation detector 36. The controller 15 outputs a drive signal to the actuator 14 (motor 33) based on a result of the processing, that is, the posture of the user. Based on the drive signal, the actuator 14 (motor 33) operates to, e.g., wind and unwind the belt body 13 and temporarily stop the winding and unwinding. Operation control of the actuator 14 (motor 33) performed using signals from the sensor 38 and the rotation detector 36 will be described later.

In a state in which the assist device 10 is worn by the user, the motor 33 constantly operates (generates torque) in a direction in which the belt body 13 is wound, with a force that is smaller than that of a case where the motor 33 generates an assist force, according to the control by the controller 15, to cause generation of small tension in the belt body 13. Consequently, the belt body 13 is not loosened.

Upon the user changing his/her posture, for example, from an upright posture to a forward-tilted posture, tension is generated in the belt body 13 because of the posture change. Therefore, in this case, upon a start of a posture change to a forward-tilted posture, the motor 33 is forcibly rotated (the motor 33 idles) by the tension of the belt body 13 irrespective of power of the actuator 14, and the belt body 13 is thereby unwound. Alternatively, upon a start of a posture change to a forward-tilted posture, the actuator 14 operates, that is, the motor 33 is driven to rotate to unwind the belt body 13.

On the other hand, upon the user changing his/her posture from a forward-tilted posture to an upright posture, the belt body 13 is about to be loosened because of the posture change. Therefore, in this case, upon a start of the posture change to an upright posture, in order to maintain tension acting on the belt body 13, the actuator 14 operates, that is, the motor 33 is driven to rotate, to wind the belt body 13.

In this way, by the user's posture change, the belt body 13 is wound or unwound. In the winding or unwinding, the motor 33 actively or passively rotates by a predetermined rotational angle. The rotational angle at this time is detected by the rotation detector 36. In this way, an amount of operation of the actuator 14 (motor 33) in winding or unwinding of the belt body 13 due to the user's posture change is detected by the rotation detector 36. Then, as described later, the controller 15 can acquire the amount of operation of the actuator 14 (rotational angle of the motor 33) in winding or unwinding of the belt body 13 due to the user's posture change, obtain a posture parameter indicating the user's posture based on the amount of operation, and based on the posture parameter, perform control of operation of the actuator 14 in order to provide an assist force to the user.

Figure 6:
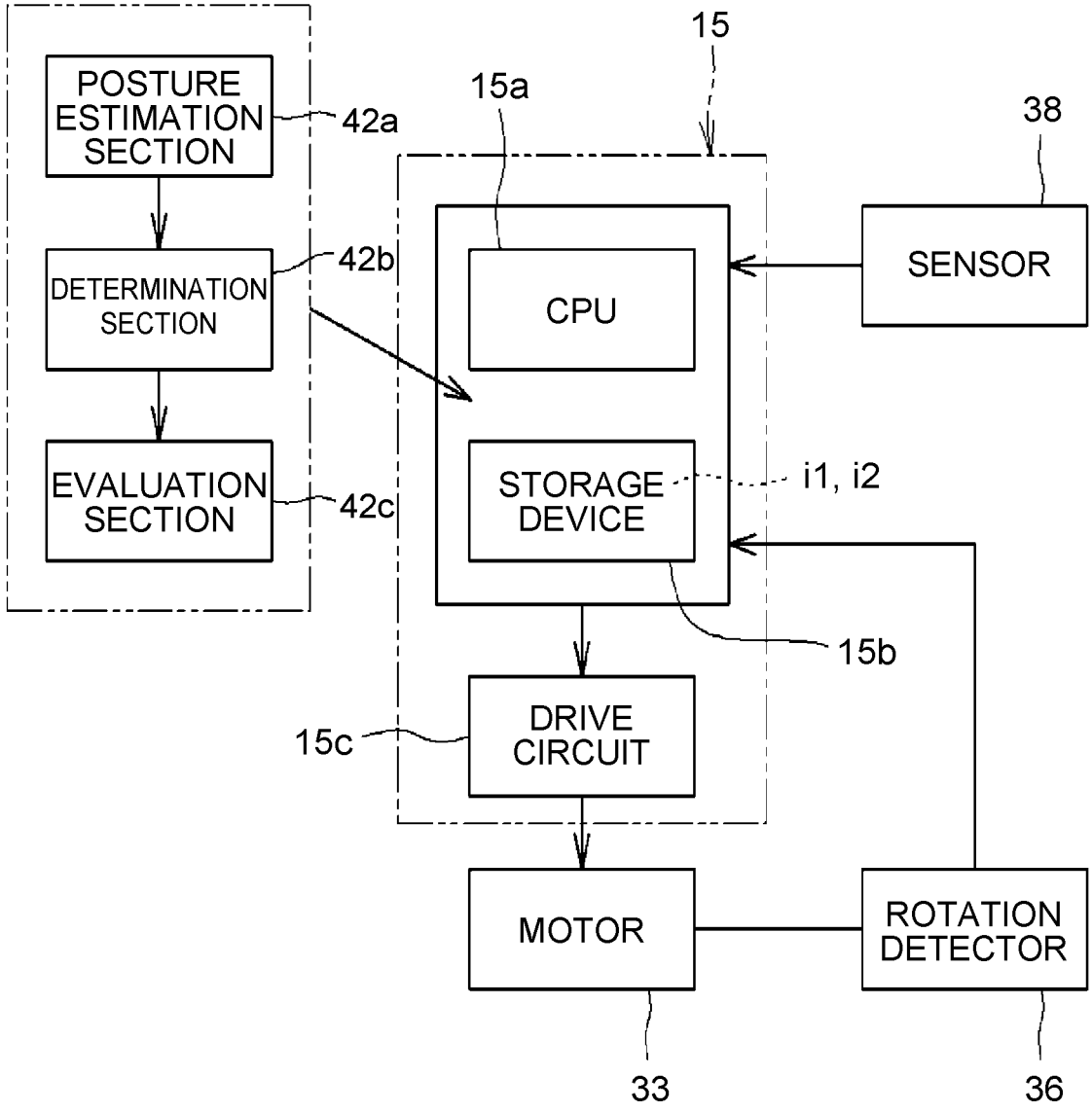
FIG. 6 is a block diagram illustrating a control configuration included in the assist device.

FIG. 6 is a block diagram illustrating a control configuration included in the assist device 10. The controller 15 is formed by a control unit including a microcomputer and includes an arithmetic processing unit (CPU) 15*a* and a storage device (storage section) 15*b* such as a memory. The arithmetic processing unit 15*a* performs various types of arithmetic processing based on various programs, various parameters, etc., stored in the storage device 15*b*. The controller 15 of the present disclosure includes a posture estimation section 42*a*, a determination section 42*b* and an evaluation section 42*c* as functional sections implemented via arithmetic processing by the arithmetic processing unit 15*a*. The controller 15 further includes a drive circuit (motor driver) 15*c* that performs operation control of the motor 33. The motor 33 performs predetermined operations via cooperation between the respective functional sections and the drive circuit 15*c*. The functional sections included in the controller 15 will be described later.

Assist Force of Assist Device 10

Figure 7:
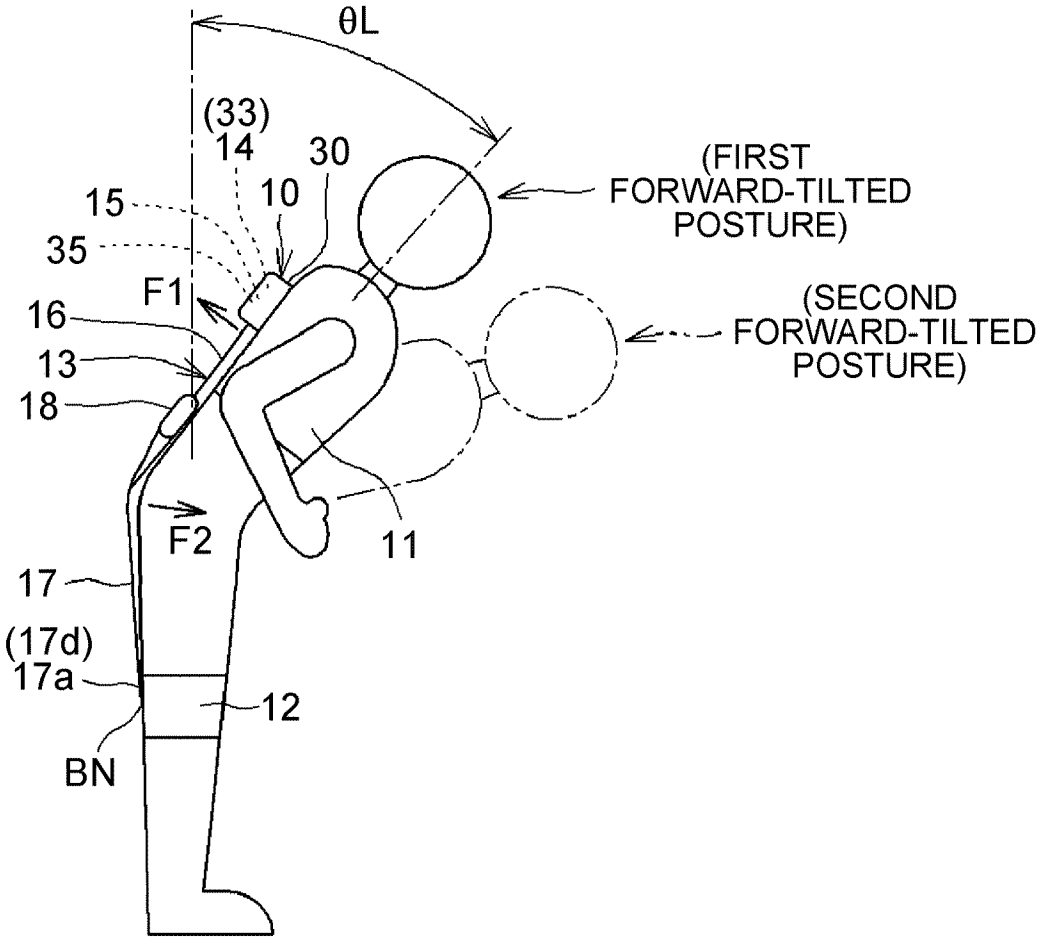
FIG. 7 is a diagram of a case where a user wearing the assist device changes his/her posture.
Figure 7:
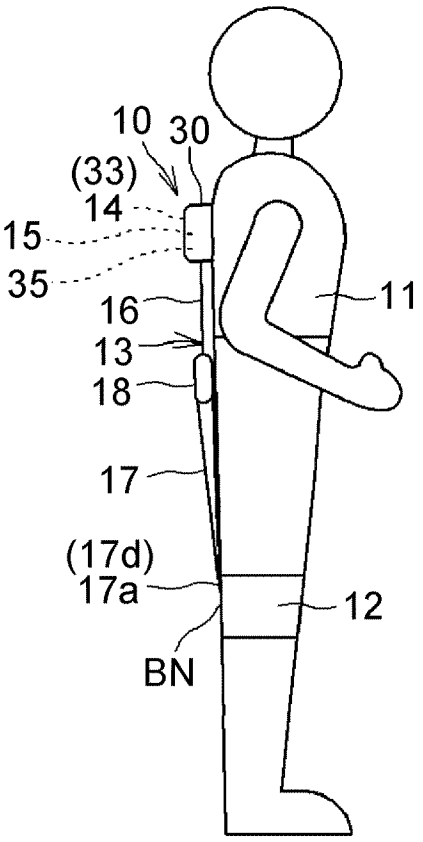

FIG. 7 is a diagram of a case where the user wearing the assist device 10 changes his/her posture. The assist device 10 can provide an assist force to the user for the posture change.

Upon the first belt 16 being wound on the drive pulley 35 by the motor 33 of the actuator 14, the joining member 18 pulls the second belt 17 up toward the actuator 14 side, that is, the upper side. The opposite end portions 17*a*, 17*d* of the second belt 17 are attached to the left and right second harnesses 12, respectively. The second harnesses 12 are fixed to the respective knee regions BN. Therefore, upon the first belt 16 being wound on the drive pulley 35, tension acts on the first belt 16 and the second belt 17. The tension acts as an assist force for the user.

A case where the user changes his/her posture from an upright posture to a forward-tilted posture will be described. Upon a start of the posture change to a forward-tilted posture, the actuator 14 unwinds the belt body 13. Alternatively, the belt body 13 is unwound irrespective of power of the actuator 14. Consequently, the user can effortlessly take a forward-tilted posture. Upon a forward-tilting angle of the upper body of the user relative to a vertical line reaching θL and the user stopping at the tilting angle of θL, the unwinding of the belt body 13 is stopped. Note that a start and an end of a posture change can be detected by the rotation detector 36 or the sensor 38.

Upon the user starting to change his/her posture in a direction from a forward-tilted posture to an upright posture, the actuator 14 winds the belt body 13. Consequently, tension is generated in the belt body 13. The tension causes generation of a rearward acting force F1 in the first harness 11. In other words, an acting force F1 is generated in a direction in which the upper body of the user having a forward-tilted posture is raised. Also, simultaneously, in the second belt 17, an acting force F2 pushing a left hip region and a right hip region of the user forward is generated by the tension. Consequently, the user can easily return from the forward-tilted posture to an upright posture.

Also, as illustrated in FIG. 4, where the user takes a bent posture (crouching posture) in which the upper body is tilted forward and the knee regions are bent, the assist device 10 can provide an assist force to the user. Where the user changes his/her posture from a bent posture to an upright posture, for example, where the user lifts up an object or a part of the body of a care-receiver, the actuator 14 winds the belt body 13. Consequently, tension is generated in the belt body 13.

The tension causes generation of a rearward acting force F1 in the first harness 11. In other words, an acting force F1 in a direction in which the upper body of the user having a forward-tilted posture is raised is generated. Also, simultaneously, the tension, which causes generation of an acting force F2 pushing the left and right hip regions of the user forward is generated in the second belt 17. Furthermore, a rearward acting force F3 is generated in the second harnesses 12. The above acting forces F1, F2, F3 reduce a load on muscles such as the back muscle, the quadriceps, etc., of the user having a stooped posture and thus enables assisting a motion of lifting up a load.

The assist device 10 also functions where the user changes his/her posture from an upright posture into a bent posture, for example, where the user lifts down an object or a part of the body of a care-receiver. In this case, the actuator 14 unwinds the belt body 13 while exerting a braking force for the unwinding of the belt body 13. In other words, the motor 33 rotates in a direction in which the belt body 13 is unwound, but torque in the winding direction is generated in the motor 33. Consequently, tension is generated in the belt body 13. In this case, also, the assist device 10 enables reducing a load on muscles such the back muscle, the quadriceps, etc., of the user in a stooped posture and thus enabling assisting a lift-down motion by means of the above acting forces F1, F2, F3. As above, the assist device 10 of the present disclosure enables reducing a load on the muscles of the waist region in a stooped posture and preventing lower back pain.

Also, according to the assist device 10 of the present disclosure, even if the user has a bent posture with one of the left and right leg regions BL on the front side and the other on the rear side (in a laterally asymmetrical state), one (on the side on which the leg region is put forward) of the left second belt portion 19 and the right second belt portion 20 of the second belt 17 can automatically become longer than the other. Upon the first belt 16 being wound by the actuator 14 in this state, tension also acts on the second belt 17, and the tension acts on both of the left second belt portion 19 and the right second belt portion 20 and thus the tension is not relieved. Therefore, as described above, even if the user has a laterally asymmetrical posture, the assist device 10 of the present disclosure enables a proper assist force to act on the user.

Where the user maintains a forward-tilted posture, also, the assist device 10 of the present disclosure enables easily maintaining the posture. In other words, as illustrated in the figure on the right side of FIG. 7, in a state in which the user has taken a first forward-tilted posture, the operation of the actuator 14 stops to prevent unwinding of the belt body 13. Even if the user attempts to take a further forward-tilted posture (second forward-tilted posture), tension of the belt body 13 connecting the first harness 11 and the second harnesses 12 prevents taking the second forward-tilted posture. In other words, the assist device 10 attempts to maintain the first forward-tilted posture of the user. For the user, it is easy to maintain the first forward-tilted posture. As a result, for example, where the user continues having the first forward-tilted posture for a long time for work, a load on the body can be reduced.

Information Stored in Controller 15

Information stored in the storage device 15*b* of the controller 15 will be described. In the storage device 15*b*, correspondence information i1 and conversion information i2 are stored.

The correspondence information i1 is information indicating a relationship between an amount of operation of the actuator 14 in winding or unwinding of the belt body 13 due to a user's posture change, and a posture parameter indicating a posture of the user. In the present disclosure, as illustrated in FIG. 7, the "posture parameter" is a tilting angle θL of the upper body of a user relative to a vertical line. The tilting angle θL is referred to as "posture angle θL". In the below, description will be provided with a posture angle θL of a user as the posture parameter. Note that the posture parameter may be another parameter and may be an angular velocity in a direction in which the posture angle θL changes other than the posture angle θL. The angular velocity can be obtained by temporal differentiation of the posture angle θL. Also, as the posture parameter, both the posture angle θL and the angular velocity may be used. Where a user has an upright posture, θL=0.

The correspondence information i1 will more specifically be described. As described above, by a user's posture change, the belt body 13 is wound or unwound, and as an amount of operation of the actuator 14 at that time, a rotational angle of the motor 33 is detected by the rotation detector 36. There is a correlation between a rotational angle θM of the motor 33 of the belt body 13 in winding or unwinding due to a user's posture change and a posture angle θL. Therefore, as illustrated in FIG. 8, correspondence information i1 indicating a relationship between rotation angle θM of the motor 33 in winding or unwinding of the belt body 13 due to a user's posture change and posture angle θL is stored in the storage device 15*b*.

Figure 8:
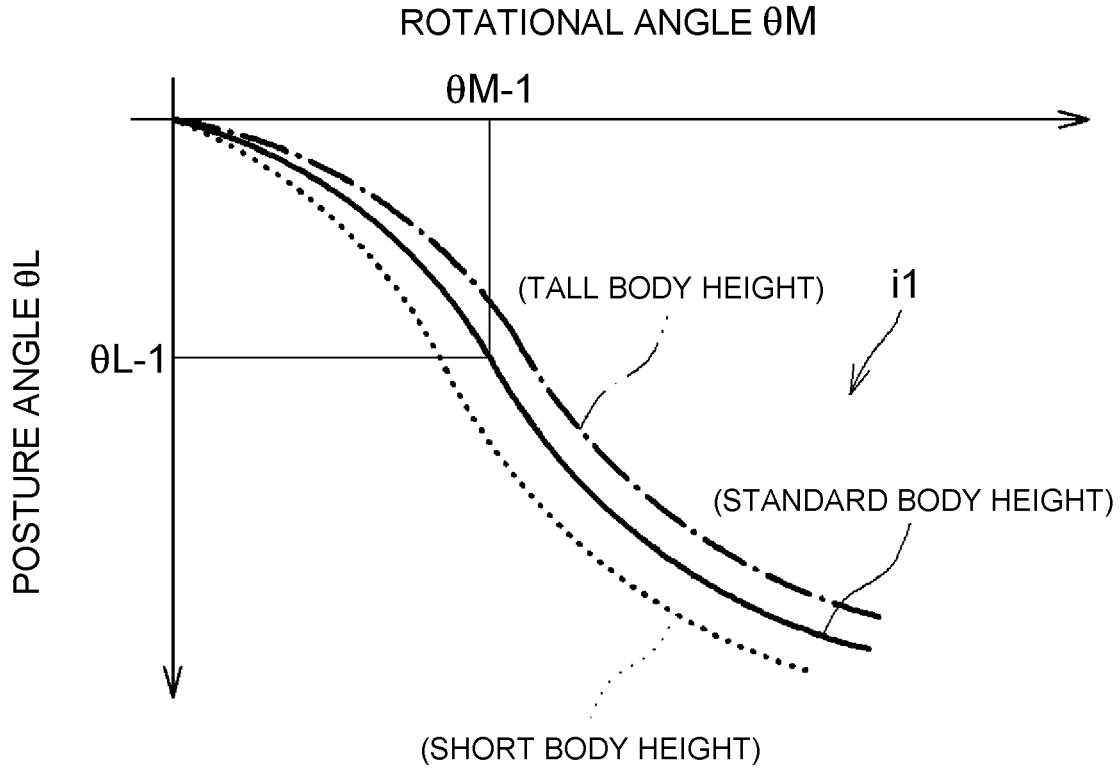
FIG. 8 is a diagram of correspondence information.

Note that the correspondence information i1 may be a function between rotational angle θM and posture angle θL or a table (database) in which rotational angle θM and posture angle θL are associated with each other, rather than a graph as illustrated in FIG. 8.

The solid line indicated in FIG. 8 is correspondence information i1 for a case where the user has a standard body height, the dash line indicated in FIG. 8 is correspondence information i1 for a case where the user has a height that is shorter than the standard body height, and the alternate short and long dash line indicated in FIG. 8 is correspondence information i1 for a case where the user has a height that is taller than the standard body height. In this way, in the present disclosure, the correspondence information i1 is information further set for respective heights of users. The correspondence information i1 for the respective heights may be a function obtained by conversion of a function indicating correspondence information for a case where the user has a standard body height, using, e.g., a coefficient, besides a format using a graph or a format using a table.

The correspondence information i1 is information generated in advance. In other words, the correspondence information i1 is generated by users having various body heights wearing the assist device 10, changing the respective posture angles (L in various ways and acquiring a rotational angle θM for each posture angle θL. Note that although not illustrated, a rotation detector that detects a rotational angle of the drive pulley 35 may be provided and a rotational angle of the drive pulley 35 may be detected. In this case, correspondence information indicating a relationship between rotational angle of the drive pulley 35 and a posture parameter (posture angle θL) is stored in the storage device 15*b*.

As illustrated in FIG. 9, the conversion information i2 is information indicating a relationship between a posture parameter (posture angle θL) and an assist force (ta, ref) provided to a user. The conversion information i2 is information generated in advance. In other words, the conversion information i2 is generated by setting assist forces to be assumed to be proper for the respective posture angles θL and associating the posture angles θL and the assist forces corresponding to the respective posture angles θL with each other. As with the correspondence information i1, the conversion information i2 may be in a format using a graph or a format using a table or may be a function. In FIG. 9, for ease of description, the conversion information i2 is in a format using a table. "A", "B", "C" and "D" indicating assist forces in FIG. 9 are predetermined values. Note that the conversion information i2 may be acquired by other means or may be an arithmetic program using another algorithm.

Note that as the posture parameter, a posture angle θL and an angular velocity in a direction in which the posture angle θL changes may be used and the conversion information i2 may be information indicating a relationship between the posture parameter (the posture angle θL and the angular velocity) and the assist force (τa, ref). In this case, the conversion information i2 is set in such a manner that for example, where the angular velocity falls within a predetermined range, as the posture angle θL is larger (in a bending direction), the assist force (τa, ref) becomes larger. Also, the conversion information i2 is set in such a manner that where the posture angle θL falls within a predetermined range, as the angular velocity is larger (in the bending direction), the assist force becomes smaller.

Functional Sections Included in Controller 15

Functions of the posture estimation section 42*a* and the determination section 42*b* will be described. It is assumed that a user wearing the assist device 10 has changed his/her posture and along with the change, the motor 33 of the actuator 14 has rotated by a predetermined angle and the rotation detector 36 has detected a rotational angle θM−1 of the motor 33 as an amount of operation of the actuator 14.

Upon obtainment of the rotational angle θM−1 of the motor 33 along with the user's posture change, the posture estimation section 42*a* estimates a posture angle θL−1 as a posture parameter, based on the rotational angle θM−1 and the correspondence information i1 (see FIG. 8).

The determination section 42*b* calculates an output of the actuator, that is, an output torque of the motor 33, as a physical amount for making the actuator 14 operate, based on the posture angle θL−1 obtained by the posture estimation section 42*a*. The output torque of the motor 33 is obtained, for example, as follows. Upon an assist force τa, ref corresponding to a posture angle GL being obtained from the conversion information i2, an output torque of the motor 33 corresponding to the assist force τa, ref is obtained. The output torque of the motor 33 is obtained via conversion of the assist force τa, ref. Alternatively, the output torque of the motor 33 may be set in association with the assist force τa, ref in the conversion information i2 (see FIG. 9) and may be extracted from the conversion information i2.

Note that in the present disclosure, a physical amount for making the actuator 14 operate is an output torque of the motor 33 and a current corresponding to the output torque is provided to the motor 33 as a drive current via the control by the controller 15. The physical amount may be another type of value or may be a current value of a current provided to the motor 33 in order to make the motor 33 generate the output torque corresponding to the assist force τa, ref.

The output torque of the motor 33 corresponding to the assist force τa, ref may be obtained with a correction. For that purpose, the determination section 42*b* further has the following function. In other words, upon the posture angle θL−1 being obtained as the posture parameter as described above, the determination section 42*b* determines the assist force τa, ref based on the conversion information i2 (see FIG. 9) and corrects the determined assist force τa, ref. The correction is performed by calculation of Expression (1) below. In other words, the correction is a correction of the determined assist force τa, ref, using a "radius rcalc of the drive pulley 35" defined as follows (see FIG. 10). The "radius rcalc of the drive pulley 35": a radius of the drive pulley 35 including the belt body 13 (first belt 16) wound on the drive pulley 35.

$$\tau M, cmd = \frac{rcalc \times \tau a, ref}{rinit \times n \times \eta} \tag{1}$$

In Expression (1) above, "τM, cmd" is a corrected output torque of the motor 33. "τa, ref" is a value based on the conversion information i2. "n" is a reduction ratio of the reducer section 34. "η" is a coefficient of the reducer section 34. "rcalc" is the radius of the "drive pulley 35" and is calculated according to Expression (2) described later. "rinit" in Expression (2) is a radius of the drive pulley 35 including the belt body 13 before the user's posture change. A value of the radius is, for example, a value obtained at the time of the user's last posture change, using Expression (2).

$$\begin{cases} \Delta r = \dfrac{\theta M \times t}{2\pi \times n} \\ rcalc = rinit + \Delta r \end{cases} \tag{2}$$

In Expression (2) above, "OM" is a rotational angle of the motor 33. The rotational angle θM−1 has been obtained as a result of the user's posture change. Here, θM=θM−1. "t" is a thickness of the belt body 13 (first belt 16). "n" is the reduction ratio of the reducer section 34. As stated above, "rinit" is the radius of the drive pulley 35 including the belt body 13 before the user's posture change.

Figure 10:
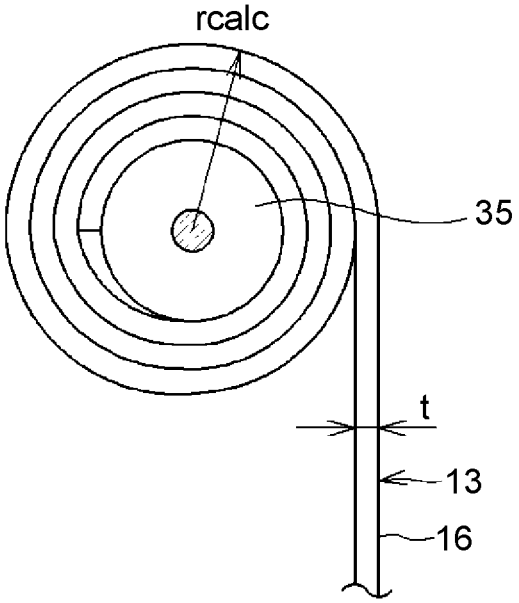
FIG. 10 is a diagram of a drive pulley on which a belt body (first belt) is wound.

The correction is performed because of the belt body 13 (first belt 16) having a certain thickness t (see FIG. 10). In other words, even where the motor 33 makes the belt body 13 be wound on the drive pulley 35 with a same output, a torque in the drive pulley 35 for generating an assist force changes because of an effect of the thickness t of the belt body 13. The correction enables eliminating the effect of the thickness t of the belt body 13 wound on the drive pulley 35 where the output torque (τM, cmd) of the motor 33 is obtained as a physical amount for making the actuator 14 operate, in order to obtain an assist force that should be provided to the user.

As above, a posture angle θL (θL−1) of a user when the user has changed his/her posture is estimated based on a rotational angle θM (θM−1) of the motor 33, and an output torque (τM, cmd) of the motor 33 is calculated based on the posture angle θL (θL−1). A current corresponding to the output torque (τM, cmd) is provided to the motor 33 as a drive current via the control by the controller 15. Note that where a correction is performed, a current corresponding to the corrected output torque of the motor 33 is provided to the motor 33 as a drive current via the control by the controller 15.

As above, the controller 15 obtains a posture angle θL based on a rotational angle θM of the motor in winding or unwinding of the belt body 13 due to a user's posture change. The controller 15 is configured to perform control of operation of the actuator 14 (motor 33) based on the obtained posture angle θL, in order to provide an assist force to the user.

Furthermore, a result of detection by the sensor 38 may be taken into consideration to obtain a physical amount for making the actuator 14 operate (an output torque of the motor 33 or a current value of a current provided to the motor 33). In other words, as described above, the controller 15 performs control of operation of the actuator 14 (motor 33) in order to provide an assist force to a user, using a result of detection by the sensor 38 in addition to an amount of operation of the actuator 14 (motor 33) in winding or unwinding of the belt body 13 due to the user's posture change. A case where a result of detection by the sensor 38 is taken into consideration will be described below.

Figure 11:
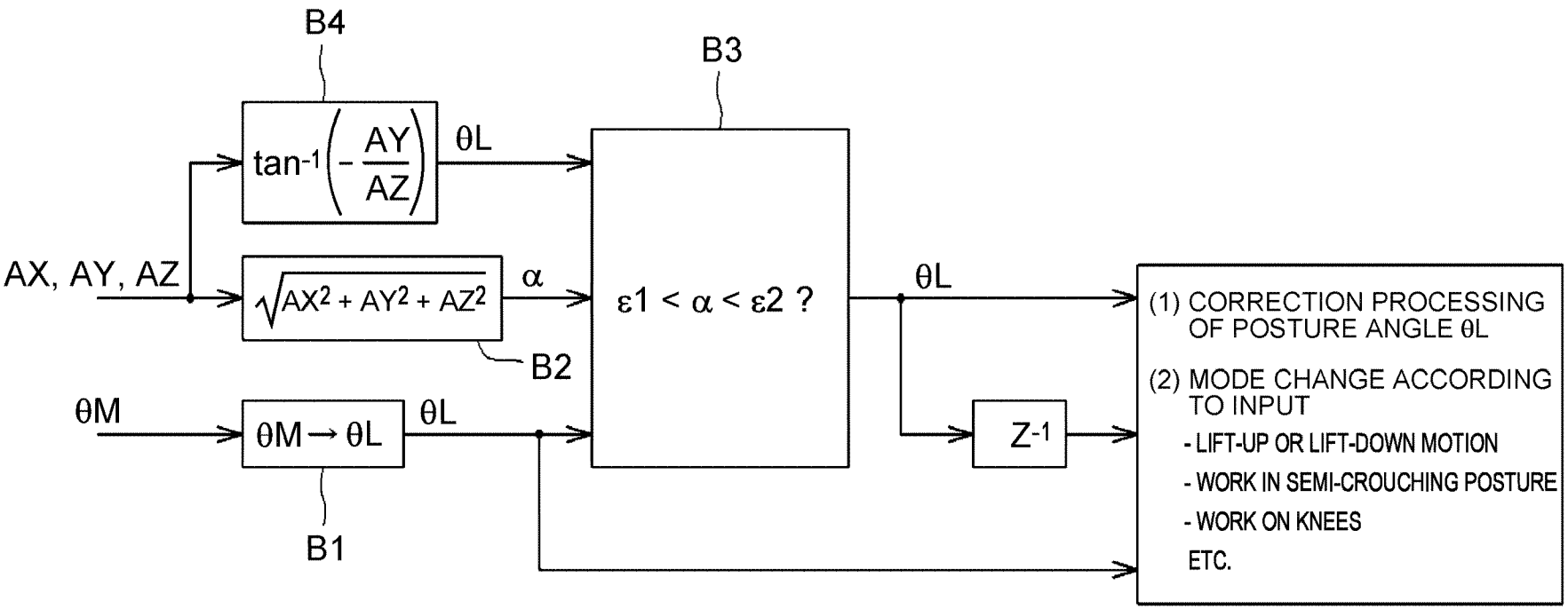
FIG. 11 is a block diagram illustrating processing performed by a controller.

FIG. 11 is a block diagram illustrating processing performed by the controller 15. Block B1 in FIG. 11 is processing for estimating a posture angle θL of a user based on a rotational angle θM of the motor 33, using the correspondence information i1 in such a manner as described above.

The sensor 38 is a triaxial acceleration sensor and constantly detects accelerations (G) in respective X-axis, Y-axis and Z-axis directions orthogonal to one another. The X-axis direction corresponds to one (right) side in a left-right direction of a user having an upright posture, the Y-axis direction corresponds to one (front) side in a front-rear direction of the user and the Z-axis direction corresponds to one (upper) side in a height direction of the user. Upon detection of accelerations by the sensor 38, the evaluation section 42*c* included in the controller 15 performs calculation of Expression (3) below (block B2 in FIG. 11). In Expression (3), AX is an acceleration in the X-axis direction, AY is an acceleration in the Y-axis direction and AZ is an acceleration in the Z-axis direction.

$$\alpha=\sqrt{AX^2+AY^2+AZ^2} \tag{3}$$

Furthermore, the evaluation section 42*c* compares a calculation result α of the calculation of Expression (3), with threshold values ε1, ε2 (block B3 in FIG. 11). The threshold value ε1 is a value that is smaller than 1 (ε1<1) and the threshold value ε2 is a value that is larger than 1 (ε2>1). Where a is larger than ε1 but is smaller than ε2 (ε1<α<ε2), a posture parameter (posture angle θL) estimated based on the result of detection by the sensor 38 (block B4 in FIG. 11) is used.

Here, where α is a value close to 1, it is estimated that the user has changed his/her posture at that position but has made no motion other than the posture change, such as walking. Note that where the user is making a walking motion, an effect of such motion is reflected in the result of detection by the sensor 38, and thus, α becomes, for example, larger than 2.

Where α is larger than ε1 but is smaller than ε2, the sensor 38 mainly detects components generated by gravity. Therefore, the evaluation section 42*c* employs a posture angle θL of the user obtained according to Expression (4) below (block B4 in FIG. 11), based on the result of detection by the sensor 38. In other words, where a is larger than ε1 but is smaller than ε2, it is proper to estimate a posture angle θL using the sensor 38. Therefore, the posture angle θL calculated according to Expression (4) below is stored in the storage device 15*b* as θLtemp.

$$\theta L = \tan^{-1}\left(-\frac{AY}{AZ}\right) \tag{4}$$

On the other hand, where ε1<α<ε2 is not satisfied, that is, where a is equal to or below ε1 or where a is equal to or exceeds ε2, the posture angle θL estimated based on the rotational angle θM of the motor 33, which is obtained in block B1, is employed. Where ε1<α<ε2 is not satisfied, it is not proper to estimate a posture angle θL using the sensor 38. Therefore, the posture angle θL estimated based on the rotational angle θM is stored in the storage device 15*b* as Ltemp.

As described above, the sensor 38 constantly detects the accelerations (G). Therefore, in the storage device 15*b*, posture angles θLtemp obtained in the past and the posture angle θLtemp obtained this time are stored. It is assumed that the posture angle Ltemp obtained this time is a "posture angle θL(N)" and the posture angle θLtemp obtained in the past (time immediately preceding this time, that is, last time) is "posture angle θL (N−1)". The evaluation section 42*c* calculates a difference ΔθL between the posture angle θL (N) and the posture angle θL (N−1) according to Expression (5) below.

$$\Delta\theta L=\theta L(N)-\theta L(N-1) \tag{5}$$

The evaluation section 42*c* further compares an absolute value of the difference ΔθL with a threshold value ε3. Where the absolute value of the difference ΔθL is equal to or below the threshold value ε3, the "posture angle θL(N)", which is the posture angle θLtemp obtained this time, is determined as a current posture angle of the user. On the other hand, where the absolute value of the difference ΔθL exceeds the threshold value ε3, the evaluation section 42*c* performs calculation according to Expression (6) below. A "posture angle θL(N)" obtained as a result of the calculation is determined as a current posture angle of the user.

$$\theta L(N)=\theta L(N-1)+\mathrm{sgn}(\Delta\theta L)\times\varepsilon 3 \tag{6}$$

(where sgn( ) is a signum function.)

In this way, significance of the evaluation section 42*c* using the difference ΔθL between the posture angle θL(N) of this time and the past posture angle θL(N−1) is as follows. In other words, if no difference ΔθL is taken into consideration, for example, if the calculation result α of calculation according to Expression (3) changes from a state in which the calculation result α satisfies ε1<α<ε2 to a state in which the calculation result α does not satisfy ε1<α<2, an instantaneous large change may be determined as occurring in the posture angle. In this case, an assist force generated by the assist device 10 abruptly changes, that is, a rotation torque of the motor 33 abruptly changes, which may make the user feel odd. However, in the present disclosure, where an absolute value of a difference ΔθL between a posture angle θL (N) of this time and a past posture angle θL (N−1) exceeds the threshold value ε3, as described based on Expression (6) above, a current posture angle θL(N) of the user is determined based on the posture angle θL (N−1), which is a past result, and a change amount ΔθL of change in posture angle. Therefore, it is possible to prevent an assist force from abruptly changing and thus prevent making the user from feeling odd.

As described above, the output torque (τM, cmd) of the motor 33 is obtained based on the current posture angle θL(N) of the user determined in such a manner as above. A current corresponding to the output torque (τM, cmd) is provided to the motor 33 as a drive current via the control by the controller 15. Also, the output torque may be corrected as described above. An operation mode of the assist device 10 may be selected or changed based on the current posture angle θL(N) of the user determined in such a manner as above.

As above, the controller 15 included in the assist device 10 of the present disclosure has a function that performs first estimation processing for estimating a posture angle θL of a user based on a rotational angle θM of the motor 33 obtained by the rotation detector 36, and a function that performs second estimation processing for estimating a posture angle θL of a user based on an output of the sensor 38. Then, the posture estimation section 42*a* of the controller 15 obtains a posture angle θL as a posture parameter, using a processing result of one of the first estimation processing and the second estimation processing.

Figure 12:
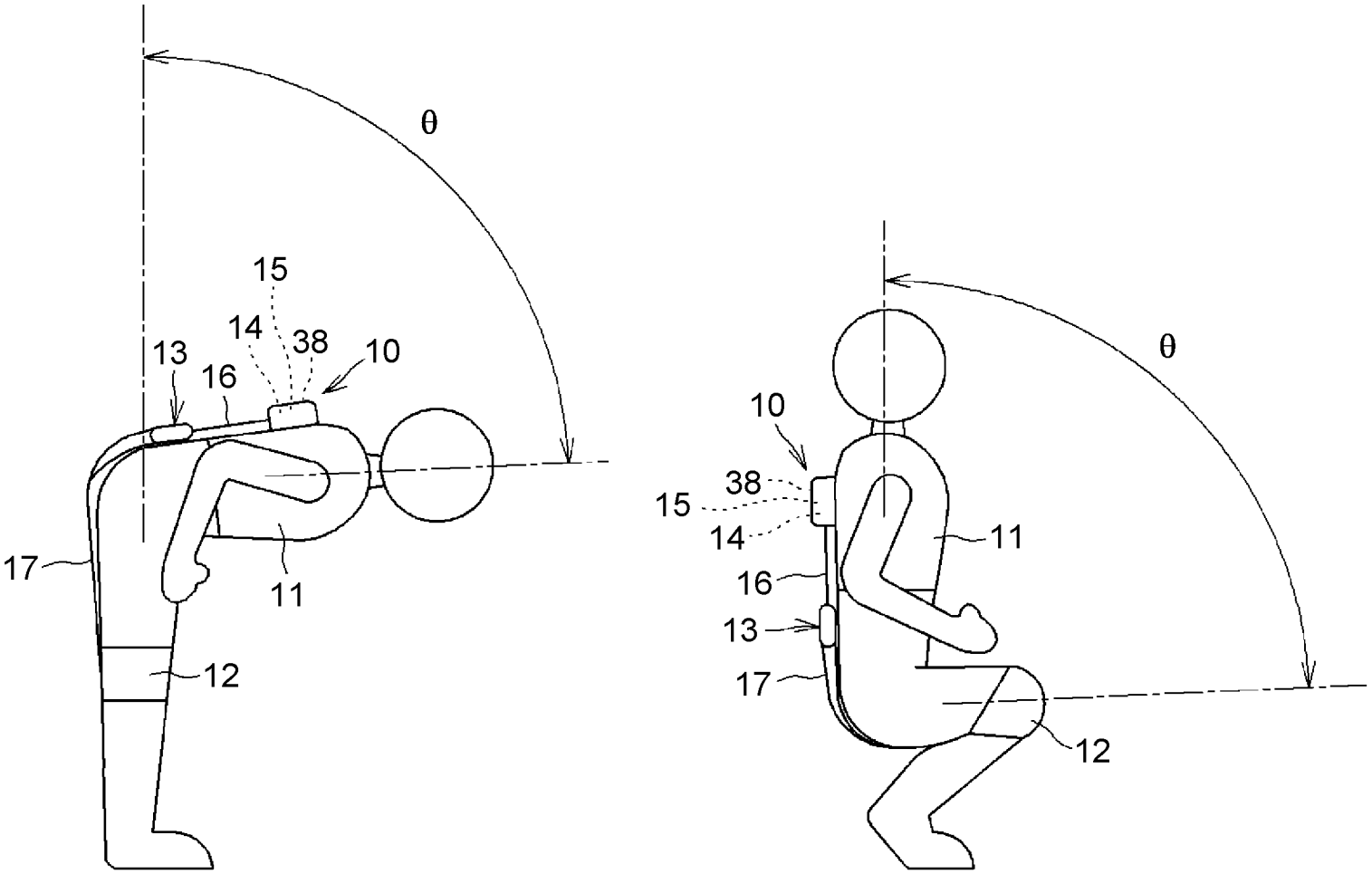
FIG. 12 is a diagram illustrating two postures of a user.

Here, significance of the controller 15 having a function that performs not only the first estimation processing but also the second estimation processing will be described. FIG. 12 is a diagram illustrating a case where a user has a forward-tilted posture in which the upper body of the user is tilted forward and a case where the user has a posture in which the user sits with his/her knees bent while the upper body stands along a vertical line. Upon comparison between the case where the user has a forward-tilted posture as illustrated in the left side of FIG. 12 and the case where the user sits with his/her knees bent as illustrated in the right side of FIG. 12, respective flexion angles θ of the upper body relative to the thighs are the same. Therefore, with the first estimation processing, respective rotational angles θM of the motor 33 are the same because respective amounts of unwinding of the belt body 13 are the same, resulting in failure to distinguish between respective posture angles θL.

On the other hand, with the second estimation processing, a tilting angle of the upper body of a user relative to a vertical line is calculated based on respective X, Y and Z-axis accelerations provided by the sensor 38. Therefore, a value of the tilting angle of the upper body, the value being obtained based on the respective X, Y and Z-axis accelerations provided by the sensor 38, is different between the case where the user has a forward-tilted posture, which is illustrated on the left side of FIG. 12, and the case where the user sits, which is illustrated on the right side of FIG. 12. In other words, with the second estimation processing, it is possible to determine whether the user has a forward-tilted posture in which the upper body is tilted forward or the user has a posture in which the user sits with his/her knees bent while the upper body stands along the vertical line.

Determining the user as having a forward-tilted posture in which the upper body is tilted forward enables the evaluation section 42*c* to estimate the user's motion mode of changing his/her posture from a forward-tilted posture to an upright posture in order to lift up a load or changing his/her posture from an upright posture to a forward-tilted posture in order to lift down a load. In this case, the assist device 10 makes the actuator 14 operate to generate an assist force for lifting up or down the load. Also, the evaluation section 42*c* can estimate the user's motion mode of doing work in a seated posture, based on determination of the user as having a posture in which the user sits with his/her knees bent while the upper body stands along a vertical line. In this case, for example, the assist device 10 generates no assist force. Note that when the user is doing work in a seated posture, if an assist force that is similar to that of a case where the user lifts up a load is generated, the user is pulled rearward and loses his/her balance.

Assist Device 10 of the Present Disclosure

As above, the assist device 10 of the present disclosure (see FIG. 2) includes the first harness 11 to be fitted to shoulder regions BS of a user, the second harnesses 12 to be fitted to left and right leg regions BL of the user, respectively, the belt body 13, and the actuator 14. The belt body 13 is provided so as to extend to the first harness 11 and to the second harnesses 12 along the back side of the user. The actuator 14 is provided in the first harness 11 and is configured to be capable of winding and unwinding a part of the belt body 13.

The belt body 13 includes the first belt 16 to be wound and unwound by the actuator 14, the second belt 17 attached to the second harnesses 12, and the joining member 18 joining the first belt 16 and the second belt 17.

According to this assist device 10, the belt body 13 is provided so as to extend to the first harness 11 and to the second harnesses 12 along the back side of a user. By the actuator 14 winding the belt body 13 (first belt 16), tension acts on the first belt 16 and the second belt 17. The tension causes generation of an assist force for assisting the users work, which reduces a burden on the body of the user.

For example, when a user (caregiver) changes his/her posture from a forward-tilted posture to an upright posture while holding a load (care-receiver) with his/her hands (see FIG. 7), tension acts on the belt body 13 by the actuator 14 winding the belt body 13. The tension makes it easy for the user to change his/her posture from a forward-tilted posture to an upright posture and thus reduces a burden on the body of the user. In other words, tension acting on the belt body 13 is generated by the actuator 14 as an assist force.

In the assist device 10 of the present disclosure, the actuator 14 can wind and unwind a part of the belt body 13 according to a user's posture change. Control of the actuator 14 is performed by the controller 15. The controller 15 obtains a posture parameter indicating a posture of the user based on an amount of operation of the actuator 14 (that is, a rotational angle of the motor 33) in winding or unwinding of the belt body 13 due to the user's posture change. Then, in order to provide an assist force to the user, the controller 15 performs control of operation of the motor 33 based on the posture parameter.

With the assist device 10 having the above configuration, upon a user changing his-her posture, the belt body 13 is wound or unwound according to the change and the motor 33 rotates in the winding or unwinding. There is a correlation between a change of a posture of a user and a rotational angle of the motor 33. Therefore, a posture parameter is obtained based on the rotational angle, and in order to provide an assist force to the user, control of operation of the motor 33 is performed based on the posture parameter. As a result, it is possible to generate an assist force according to the user's posture.

As illustrated in FIG. 8, the correspondence information i1 indicating a relationship between rotational angle θM of motor 33 in winding or unwinding of the belt body 13 due to a user's posture change and posture parameter (posture angle θL) is stored in the storage device 15*b* of the controller 15. Upon a rotational angle θM of the motor 33 being obtained along with a user's posture change, the posture estimation section 42*a* of the controller 15 estimates a posture parameter (posture angle θL) based on the rotational angle θM and the correspondence information i1. The determination section 42*b* of the controller 15 obtains an output torque of the motor 33 or a current value of a current supplied to the motor 33 as a physical amount for making the motor 33 operate, based on the estimated posture parameter (posture angle θL).

With the above configuration, upon a user changing his/her posture to a predetermined posture and a rotational angle θM of the motor 33 at the time of the posture change being obtained, a posture parameter (posture angle θL) can be obtained based on the correspondence information i1. The posture parameter (posture angle θL) indicates the posture of the user. A physical amount for making the motor 33 operate according to the posture parameter (the posture of the user) is determined based on the obtained posture parameter (posture angle θL). Consequently, the assist device 10 can generate an assist force of a proper strength according to the posture of the user.

Note that where the height of the user is different, the rotational angle of the motor 33 may be different even though the change of the posture is the same. However, in the present disclosure, as illustrated in FIG. 8, the correspondence information i1 is information set for respective heights of users. Therefore, even though the height of the user is different, the posture parameter (posture angle θL) can be obtained.

The belt body 13 (first belt 16) has a certain thickness t. Even where the motor 33 makes the belt body 13 be wound on the drive pulley 35 with a same output, a torque in the drive pulley 35 for generating an assist force may change because of an effect of the thickness t of the belt body 13 (first belt 16).

Therefore, in the present disclosure, upon a posture parameter (posture angle θL) being estimated, the determination section 42*b* included in the controller 15 determines an assist force based on the conversion information i2 and corrects the determined assist force according to Expression (1) above. The correction is performed using the radius rcalc (see FIG. 10) of the drive pulley 35 including the belt body 13 wound on the drive pulley 35. As a result of the correction being performed, the effect of the thickness t of the belt body 13 wound on the drive pulley 35 is eliminated.

Furthermore, in the assist device 10 of the present disclosure, the controller 15 is configured to perform control of operation of the motor 33 in order to provide an assist force to a user, using a result of detection by the sensor 38 (posture detector) in addition to a rotational angle of the motor 33 in winding or unwinding of the belt body 13 due to the user's posture change.

In other words, the controller 15 includes the posture estimation section 42*a* that estimates a posture angle θL as a posture parameter indicating a posture of a user. The posture estimation section 42*a* estimates a posture angle θL based on an output of the sensor 38 formed of an acceleration sensor, that is, based on a result of comparison between a result of calculation of Expression (3) and threshold values (ε1, ε2), using a result of one of the first estimation processing and the second estimation processing that are defined as follows. First estimation processing: estimation processing performed based on a rotational angle of the motor 33 in winding or unwinding of the belt body 13 due to a user's posture change. Second estimation processing: estimation processing performed based on an output of the sensor 38 formed of an acceleration sensor.

The controller 15 further includes the determination section 42*b* that calculates a physical amount for making the actuator 14 operate, based on the estimated posture angle θL. The physical amount is, for example, an output torque of the motor 33 or a current value of a current provided to the motor 33.

With this configuration, where it is proper to estimate a posture angle θL using the sensor 38, that is, where a calculation result α obtained according to Expression (3) above is larger than ε1 but is smaller than ε2, the second estimation processing is performed. Where it is not proper to estimate a posture angle θL using the sensor 38, that is, where a is equal to or below ε1 or where a is equal to or exceeds ε2, the first estimation processing based on a rotational angle of the motor 33 is performed. Accuracy of estimation of a user' posture is thus enhanced, enabling the assist device 10 to generate an assist force of a proper strength according to the user's posture. Also, it becomes possible to estimate an intension of motion, that is, a work mode, of a user, enabling generating a proper assist force without hindering the user's motion.

Also, in the present disclosure, as described above, in order to estimate a posture angle θL, a result of one of the first estimation processing and the second estimation processing is used. Therefore, there may be a large difference in estimated posture angle θL between last time and this time. As a result, the physical amount for making the actuator 14 operate may largely change and such large change may make the user feel odd.

Therefore, in the assist device of the present disclosure, the posture estimation section 42*a* repeatedly performs estimation of a posture angle θL. Then, where an amount of change of the posture angle θL (absolute value of a difference ΔθL in the above) exceeds a threshold value (ε3), a new posture angle θL(N) is obtained based on a posture angle θL (N−1) estimated in the past and the amount of change of the posture angle 6L (difference ΔθL). In this case, even if there is a large difference in posture angle θL estimated by the posture estimation section 42*a* between last time and this time, a new posture angle θL(N) is obtained based on the posture angle θL (N−1) estimated in the past and the difference ΔθL. Therefore, it becomes possible to prevent the physical amount for making the actuator 14 operate from largely changing. Therefore, the user is prevented from feeling odd.

Note that for estimation of a posture angle θL, the following "Procedure 1" or "Procedure 2" can be employed. Procedure 1: First, whether or not it is proper to estimate a posture angle θL using the sensor 38 is determined, and subsequently, according to a result of the determination, one of the first estimation processing and the second estimation processing is performed and a result of the processing is used. Procedure 2: First, the first estimation processing and the second estimation processing are performed, and subsequently, whether or not it is proper to estimate a posture angle 8L using the sensor 38 is determined, and a result of one of the first estimation processing and the second estimation processing is used according to a result of the determination.

Other Assist Devices 10

Figure 13:
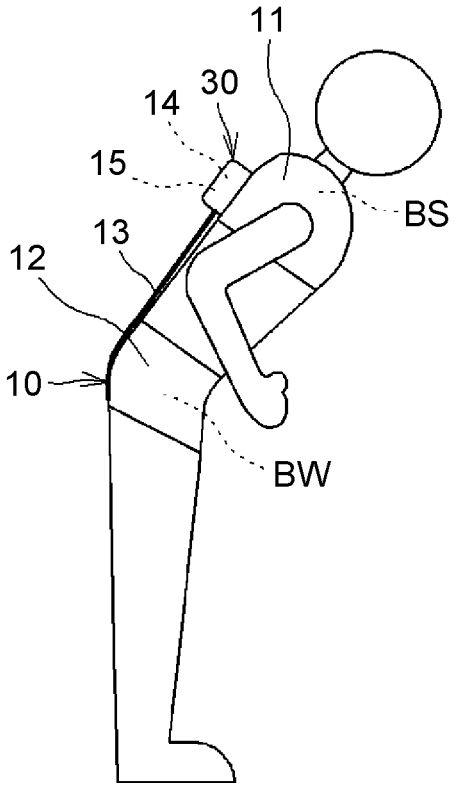
FIG. 13 is a side view illustrating another form of assist device.

In the assist device 10 disclosed above, the second harnesses 12 are fitted to the leg regions BL of the user. As illustrated in FIG. 13, a second harness 12 may be fitted to a waist region BW of a user. In this case, the second harness 12 may have the shape of a waist belt or the shape of pants. Where a second harness 12 is fitted to a waist region BW an actuator 14 may be attached to a first harness 11 or may be attached to the second harness 12. In this case, the sensor 38 that detects a posture of a user may be provided in the second harness 12. In FIG. 13, an actuator 14 is attached to a first harness 11.

In the case of the assist device 10 illustrated in FIG. 13, also, a belt body 13 is provided so as to extend to the first harness 11 and to the second harness 12 along the back side of the user. By the actuator 14 winding the belt body 13, tension acts on the belt body 13. The tension causes generation of an assist force for assisting the user's work, which reduces a burden on the body of the user.

For prevention of pain in the lower back of a user, it is preferable that the second harnesses 12 be fitted to leg regions BL. This is because a load on a waist region BW can be reduced by the second harness 12 being fitted to leg regions BL. In each form of assist device 10, the belt body 13 is light in weight and can conform to the body of a user even if the user changes his/her posture, and thus follows movement of the user. Therefore, an assist device 10 that provides good wear comfort can be provided. Note that in the above disclosure, the control box 30 is provided on the rear side (back side) of a user in the first harness 11 but may be provided on the front side of a user. In this case, the belt body 13 is provided along the back of the user through shoulder regions BS of the user.

The linear form of the belt body 13 may be a form other than the illustrated form. For example, although not illustrated, as with the second attachment portion 28, a rotary pulley may be provided on the first attachment portion 27 of the joining member 18 and a first belt 16 may be hung on the rotary pulley so as to be folded at an intermediate point of the first belt 16. In this case, an end portion (on the side opposite to the drive pulley 35 side of the first belt 16) of the first belt 16 is attached to the first harness 11 (base 31). Alternatively, although not illustrated, a rotary pulley may be provided at each of the second harnesses 12 and a second belt 17 may be hung on the rotary pulley so as to be folded at an intermediate point of the second belt 17. In this case, opposite end portions of the second belt 17 are attached to a harness (third harness) to be fitted to a waist region BW.

The embodiment disclosed herein is a mere example in every respect and is not limiting. The scope of the right for the present disclosure is not limited to the above embodiment but includes all changes that come within the meaning and range of equivalency of the claims.

What is claimed is:

1. An assist device comprising:

a first harness to be fitted to at least one of a shoulder region and a breast region of a user;

a second harness configured to be fitted to one of a leg region and a waist region of the user;

a belt body provided so as to extend to the first harness and to the second harness along a back side of the user;

wherein the belt body comprises a first belt, a second belt and a joining member;

wherein the joining member is a rectangular ring;

wherein one end of the first belt is wound on a drive pulley and the other end of the first belt is fixed to a first attachment portion of the rectangular ring;

wherein a second attachment portion of the rectangular ring comprises a shaft portion and a rotary pulley and wherein the second belt is hung on the rotary pulley so as to be folded at an intermediate portion of the second belt;

an actuator provided in one of the first harness and the second harness, the actuator being configured to wind a part of the belt body and being configured to unwind the part of the belt body; and a controller configured to perform operation control of the actuator, characterized in that the controller is configured to perform the operation control of the actuator based on a posture change of the user, wherein the first harness includes a sensor that outputs a signal to the controller according to a posture of the user; and the controller performs the operation control of the actuator in order to provide an assist force to the user, based on the signal of the sensor.

2. The assist device according to claim 1, wherein the controller is configured to obtain a posture parameter indicating a posture of the user based on an amount of operation of the actuator in winding or unwinding of the belt body due to the posture change of the user and is configured to perform the operation control of the actuator based on the posture parameter in order to provide an assist force to the user.

3. The assist device according to claim 2, wherein:

the controller includes a storage section, a posture estimation section and a determination section;

the storage section is configured to store correspondence information indicating a relationship between the amount of operation of the actuator in winding or unwinding of the belt body due to the posture change of the user, and the posture parameter;

the posture estimation section is configured to, upon the amount of operation of the actuator being obtained along with the posture change of the user, obtain the posture parameter based on the amount of operation and the correspondence information; and the determination section is configured to obtain a physical amount for making the actuator operate, based on the obtained posture parameter.

4. The assist device according to claim 1, wherein:

the controller is configured to:

estimate a posture parameter indicating the posture of the user;

obtain a physical amount for making the actuator operate, based on the estimated posture parameter; and estimate the posture parameter based on the output of the sensor, using a result of one of first estimation processing and second estimation processing wherein the first estimation processing is estimation processing performed based on an amount of operation of the actuator in winding or unwinding of the belt body due to the posture change of the user, and the second estimation processing is estimation processing performed based on the output of the sensor.

5. The assist device according to claim 4, wherein:

the posture estimation section is configured to repeatedly perform estimation of the posture parameter; and the posture estimation section is configured to, where an amount of change of the posture parameter exceeds a threshold value, obtain a new posture parameter based on the past estimated posture parameter and the amount of change.

6. The assist device according to claim 3, wherein the correspondence information is information set for respective body heights for the user.

7. The assist device according to claim 3, wherein:

the storage section is configured to store conversion information indicating a relationship between the posture parameter and the assist force to be provided to the user; and the determination section is configured to, upon the posture parameter being obtained, determine the assist force based on the conversion information and is configured to obtain the physical amount corresponding to the assist force.

8. The assist device according to claim 7, wherein: the actuator includes the drive pulley configured to wind the belt body and a motor configured to make the drive pulley perform an operation of winding the belt body; and the determination section is configured to correct the determined assist force using a radius of the drive pulley including the belt body wound on the drive pulley.

9. The assist device according to claim 1, wherein the controller is configured to perform the operation control of the actuator in order to provide an assist force to the user, using an amount of operation of the actuator in winding or unwinding of the belt body due to the posture change of the user, and an output of the sensor.

* * * * *